US005601216A

United States Patent [19]

Visco

[11] Patent Number: 5,601,216

[45] Date of Patent: Feb. 11, 1997

[54] PACKAGING INCLUDING HOLDER ATTACHMENT FOR TUBULAR APPLICATORS AND THE LIKE

[76] Inventor: John Visco, 334 Jeffer St., Ridgewood, N.J. 07450

[21] Appl. No.: 571,391

[22] Filed: Dec. 13, 1995

[51] Int. Cl.[6] ..... B65B 13/16

[52] U.S. Cl. ..... 222/538

[58] Field of Search ..... 222/538, 530, 222/192

[56] References Cited

U.S. PATENT DOCUMENTS

| | | | |
|---|---|---|---|
| 4,805,814 | 2/1989 | Allen, Sr. | 222/538 |
| 4,819,838 | 4/1989 | Hart, Jr. | 222/538 |
| 4,823,445 | 4/1989 | Diener | 222/538 X |
| 4,941,594 | 7/1990 | Larson | 222/538 X |
| 5,143,263 | 9/1992 | Newell | 222/538 |
| 5,409,145 | 4/1995 | Payne | 222/538 X |
| 5,411,187 | 5/1995 | Schwab | 222/538 |

*Primary Examiner*—Kevin P. Shaver
*Attorney, Agent, or Firm*— Bachman & Lapointe, P.C.

[57] ABSTRACT

An attachment and a method for making an attachment for a product in a container, comprising the steps of: providing a back sheet having a front surface and a back surface, the back surface having adhesive for securing to the container; providing a front sheet having a front surface and a back surface; positioning an applicator adhesive for the product between the front surface of the back sheet and the back surface of the front sheet; and securing the front sheet to the back sheet so as to provide the attachment including the applicator adhesive enclosed between the front sheet and the back sheet whereby the attachment can be attached to the container with the adhesive.

21 Claims, 2 Drawing Sheets

PACKAGING INCLUDING HOLDER ATTACHMENT FOR TUBULAR APPLICATORS AND THE LIKE

CROSS-REFERENCE TO DISCLOSURE DOCUMENT

This application is related to Disclosure Document Number 378812 filed Jun. 16, 1995.

BACKGROUND OF THE INVENTION

The invention relates to an improved package for products which use applicators and other devices. More specifically, the invention relates to an improved package for canned fluid products such as WD40®, which is a canned lubricant under pressure which is applied through a spray nozzle.

For specific applications of lubricant, a tubular applicator is provided for insertion into the nozzle so as to provide a more concentrated stream of product as desired. Conventionally, the applicator is provided along with the product and is held to the side of the product by a piece of adhesive tape. For the first use of the applicator, the tape must be removed and is generally not useful for reattaching the applicator to the can after use. Further, such products are generally provided with a cap for covering the spray nozzle, which cannot be replaced unless the applicator is removed. Due to the lack of an effective mechanism for re-securing the applicator to the can, the applicator frequently becomes lost well prior to the depletion of the contents of the can.

It is therefore the primary object of the present invention to provide an improved package for such a product wherein provision is made for receiving and holding the applicator when needed.

It is a further object of the present invention to provide a method for making an attachment for holding an applicator for a product in a container.

Other objects and advantages will appear hereinbelow.

SUMMARY OF THE INVENTION

In accordance with the invention, the foregoing objects and advantages are readily attained.

According to the invention, an attachment member for a product in a container is disclosed, which attachment member comprises: applicator means for application of said product; a back sheet having a front surface and a back surface, and means for securing to said container positioned on said back surface; a front sheet having a front surface and a back surface, said front sheet being secured to said back sheet with said applicator means releasably enclosed therebetween.

In further accordance with the invention, a method for making an attachment according to the invention is provided, which method comprises the steps of: providing a back sheet having a front surface and a back surface, said back surface having means for securing to said container; providing a front sheet having a front surface and a back surface; positioning an applicator means for said product between said front surface of said back sheet and said back surface of said front sheet; and securing said front sheet to said back sheet so as to provide said attachment including said applicator means enclosed between said front sheet and said back sheet whereby said attachment can be attached to said container with said means for securing.

BRIEF DESCRIPTION OF THE DRAWINGS

A detailed description of preferred embodiments of the invention follows with reference to the attached drawings, wherein.

DETAILED DESCRIPTION

Figure 1:
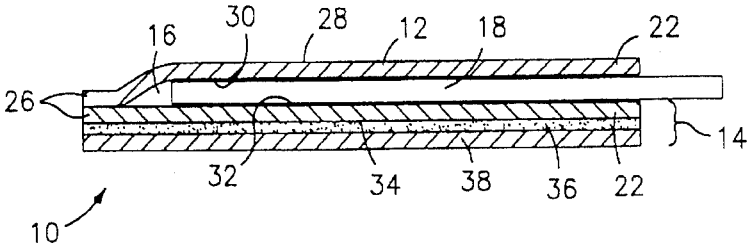
FIG. 1 is a side sectional view of an attachment according to the present invention.

The invention relates to an attachment, referred to generally in the drawings by reference numeral 10, for use in holding an applicator for a product in a container, whereby the applicator is readily removed for use and returned to the attachment after use so as to prevent the loss of the applicator prior to depletion of the product in the container.

Figure 5:
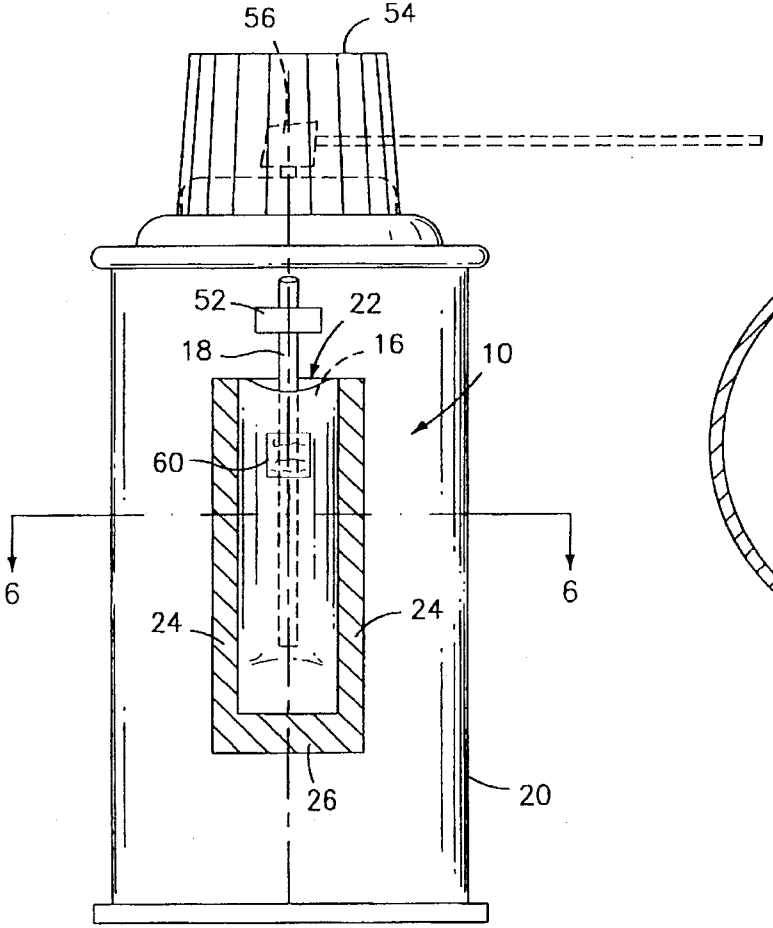
FIG. 5 is a side view of a container including an attachment according to the invention.

Referring to the drawings, FIG. 1 illustrates attachment 10 in accordance with the present invention. As shown in FIG. 1, attachment 10 according to the invention preferably includes a front sheet 12 and a back sheet 14 which are preferably secured together according to the invention so as to define a pouch area 16 for holding an applicator tube 18 or other device for use in connection with a product in a container. Referring also to FIG. 5 which shows an attachment 10 positioned on a container 20 in accordance with the invention, front sheet 12 and back sheet 14 preferably each have top edge portions 22, side edge portions 24 and a bottom edge portion 26. In accordance with the invention, front sheet 12 and back sheet 14 are preferably secured to each other, at least at side edge portions 24, and preferably also at bottom edge portion 26, so as to define pouch area 16 therebetween having a substantially open top edge portion 22 whereby applicator tube 18 can be readily removed from and returned to pouch area 16 as desired. Attachment 10 in accordance with the invention thereby provides a readily accessible and convenient area for storage of applicator tube 18 so as to prevent the premature loss of applicator tube 18 due to lack of an effective and convenient area for storage of same.

Returning to FIG. 1, front sheet 12 preferably has a front surface 28 and a back surface 30, and back sheet 14 preferably has a front surface 32 and a back surface 34. According to the invention, front sheet 12 and back sheet 14 are preferably secured to each other at back surface 30 of front sheet 12 and front surface 32 of back sheet 14.

In further accordance with the invention, back surface 34 of back sheet 14 preferably includes an adhesive layer 36 for securing attachment 10 to a container or can 20 in accordance with the invention. Adhesive layer 36 is preferably any suitable adhesive which should be selected based upon the material of which container 20 is made and any concerns with respect to the product to be contained in container 20.

Also as shown in FIG. 1, back sheet 14 preferably further includes a peelable backing member 38 peelably exposed over adhesive layer 36 so as to cover adhesive layer 36 until attachment 10 is to be applied to a container 20. In accordance with the invention, peeling of peelable backing member 38 serves to expose adhesive layer 36 for ease in securing attachment 10 to container 20 as desired.

Figure 2:
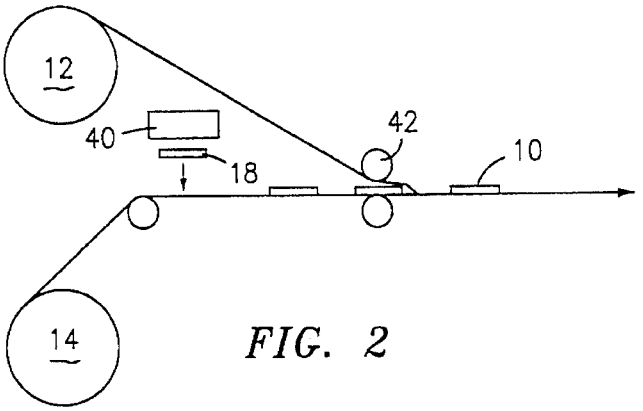
FIG. 2 is a schematic view illustrating a method for making an attachment according to the invention.

Referring now to FIG. 2, a method for making attachment 10 in accordance with the invention is schematically illustrated. As shown, back sheet 14 may suitably be provided in roll form so that attachments 10 are prepared in a continuous manner. Back sheet 14 in accordance with the invention is preferably fed to a first station 40 wherein applicator tubes 18 are positioned on back sheet 14 as desired.

Front sheet 12 is also preferably provided in roll form, and is fed to a second station 42 for positioning over applicator tube 18 and substantially adjacent to back sheet 14. At second station 42, front sheet 12 and back sheet 14 are preferably secured together as described above so as to provide attachment 10 in accordance with the invention.

Figure 3:
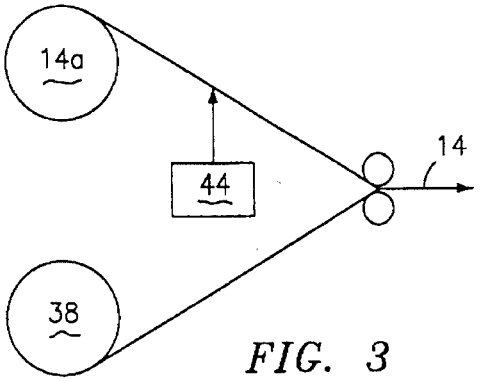
FIG. 3 is a side schematic view of a further portion of a method for making an attachment according to the invention.

Referring to FIG. 3, a method for providing back sheet 14 in accordance with the invention is also illustrated. As shown, back sheet 14 may be provided in roll form to an adhesive application station 44, and then fed to a backing station 46 wherein peelable backing member 38 is applied to back surface 32 of back sheet 14 over adhesive layer 36. Of course, the adhesive layer and backing portions of back sheet 14 may also be provided in numerous other manners which may be readily apparent to one of ordinary skill in the art.

Figure 4:
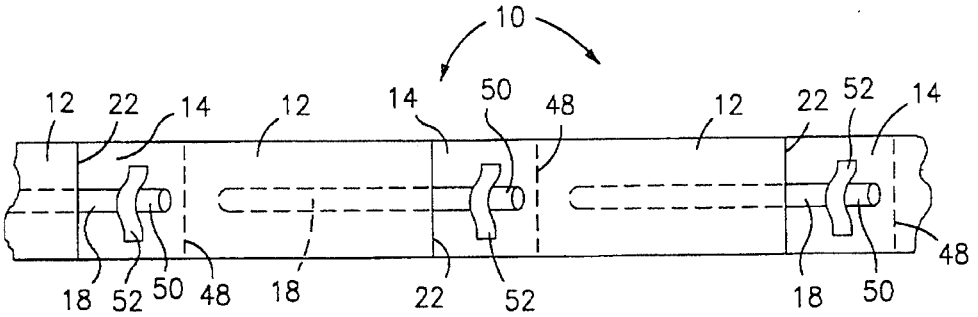
FIG. 4 is a top schematic view of a strip of attachments made according to the method of the present invention.

Referring now to FIG. 4, attachments 10 in accordance with the invention may preferably be provided in a continuous strip as illustrated and may further be provided with perforations 48 or other means for facilitating the separation of a strip of attachments into individual units. Also as shown in FIG. 4, applicator tube 18 preferably extends beyond top edge portion 22 of front sheet 12 so as to provide an exposed portion 50 of applicator tube 18 so as to facilitate removal of applicator tube 18 from attachment 10 as desired. This may be provided, for example, by removing a section of front sheet 12 after front sheet 12 and back sheet 14 are secured together.

Still referring to FIG. 4, a securing member 52 such as conventional adhesive tape and the like may preferably be provided over exposed portion 50 of applicator tube 18 so as to secure applicator tube 18 in position within attachment 10 until applicator tube 18 is to be used. Advantageous, securing member 52 serves to hold applicator tube 18 in position within attachment 10 during shipping, handling and fixation of attachment member 10 to container 20 so that container 20 with attachment 10 can be provided to consumers with applicator tube 18 firmly held in place.

In this regard, it should be noted that it is anticipated that attachment 10 may be provided to consumers already attached to container 20, or, alternatively, attachment 10 still including peelable backing member 38 may be provided in a package including container 20 for application to container 20 by the consumer.

Returning to FIG. 5, container 20 is illustrated as having a cap 54 for covering a nozzle 56 into which applicator tube 18 is positioned for use. As clearly illustrated in FIG. 5, applicator tube 18 must be removed prior to replacement of cap 54 over nozzle 56. Conventionally, no provision was made for holding applicator tube 18 after removal from nozzle 56, and applicator tube 18 is frequently lost or misplaced. FIG. 5 clearly illustrates the advantages of the present invention whereby applicator tube 18 is readily returned to pouch area 16 defined by attachment 10 for convenient and reliable storage until the next use.

Figure 6:
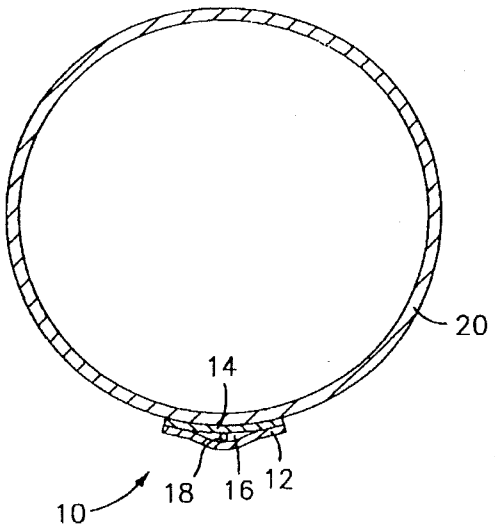
FIG. 6 is a sectional view taken along the lines 6—6 of FIG. 5 further illustrating an apparatus according to the present invention.

Referring now to FIG. 6, attachment 10 in accordance with a preferred embodiment of the invention is further illustrated. As shown, attachment 10 is secured to container 20 at back surface 34 of back sheet 14, with applicator tube 18 contained in pouch area 16 defined between front sheet 12 and back sheet 14.

Figure 7:
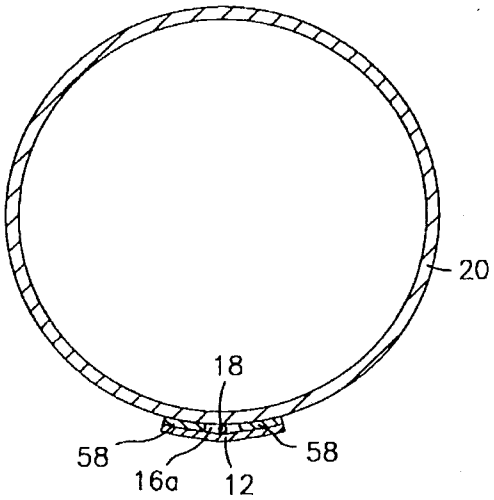
FIG. 7 is a sectional view similar to FIG. 6 illustrating an alternative embodiment of the invention.

Referring now to FIG. 7, an alternate embodiment of the invention is further illustrated. In this simple embodiment of the invention, pouch area **16*a* is defined between front sheet 12 and container 20 itself. In this embodiment, front sheet 12 is attached to container 20 through adhesive or other securing method preferably applied at least to side edge portions 24 and, preferably, bottom edge portion 26 as well. FIG. 7 schematically illustrates adhesive 58 positioned at side edge portions 24 as desired. It should be noted that the embodiment of FIG. 7 is most preferable for applications where attachment 10 is to be applied directly to container 20 during the preparation of container 20. In this regard, if attachment 10 is to be applied during a continuous process of preparation of container 20, no back sheet 14 with peelable backing member 38 is required. However, it should also be readily apparent that attachment 10 in accordance with the embodiment of FIG. 7 could of course be provided with a peelable backing member (not shown) positioned over adhesive 58** if desired.

Figure 8:
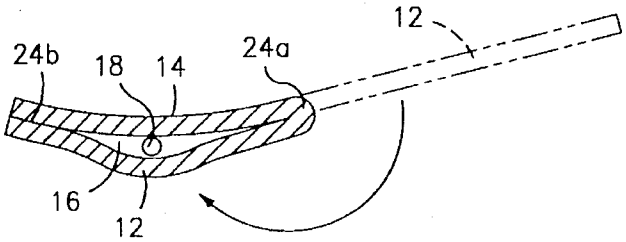
FIG. 8 is a sectional view illustrating a further alternate embodiment of the invention.

Referring now to FIG. 8, a further alternative embodiment of the invention is illustrated. As shown, front sheet 12 and back sheet 14 may suitably be formed from a single piece of material, for example joined along a side edge portion **24*a*. In this embodiment, attachment 10 may suitably be manufactured by positioning applicator tube 18 on back sheet 14, and folding front sheet 12 along joined side edge portion 24*a* so as to enclose applicator tube 18. Front sheet 12 and back sheet 14 are then preferably secured at side edge portion 24*b* so as to define pouch area 16 containing applicator tube 18** as desired.

Returning now to FIG. 5, and in accordance with a further alternative embodiment of the invention, indicia 60 may be positioned on one or more of front sheet 12 or back sheet 14 so as to be visible at front surface 28 of front sheet 12. Indicia 60 may be art work or other depiction designed to enhance the appearance of attachment 10, for example in cooperation with applicator tube 18 if desired, and may serve to greatly enhance the consumer appeal of a product bearing attachment 10.

In accordance with the foregoing, it should be readily apparent that a method and apparatus have been described in accordance with the present invention which provide a simple, efficient and cost effective attachment for use in storing an applicator tube for a product in a container, thereby preventing loss of the applicator tube prior to depletion of the contents of the container.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for making an attachment for a product in a container, comprising the steps of:

providing a back sheet having a front surface and a back surface, said back surface having means for securing to said container;

providing a front sheet having a front surface and a back surface;

positioning an applicator means for said product between said front surface of said back sheet and said back surface of said front sheet; and securing said front sheet to said back sheet so as to provide said attachment including said applicator means enclosed between said front sheet and said back sheet whereby said attachment can be attached to said container with said means for securing.

2. A method according to claim 1, wherein said front sheet and said back sheet each have a top edge portion, a bottom edge portion, and side edge portions, and wherein said securing step comprises the step of securing said side edge portions of said front sheet and said back sheet together.

3. A method according to claim 2, wherein said securing step further comprises securing said bottom edge portion of said front sheet and said back sheet so as to provide a pouch having secured side portions and a secured bottom portion, and a substantially unsecured top portion whereby said applicator means can be removed from and returned to said pouch through said substantially unsecured top portion.

4. A method according to claim 1, wherein said step of providing said back sheet comprises providing said back sheet having said means for securing comprising adhesive means positioned on said back surface of said back sheet and peelable back means for covering said adhesive means whereby peeling said backing means exposes said adhesive means for attaching to said container.

5. A method according to claim 1, wherein said container is a can, said product is a fluid product, and said applicator means is a tubular member for transporting a stream of said fluid product from said can.

6. A method according to claim 2, wherein said front sheet and said back sheet are joined along one edge portion of said bottom edge portion or a side edge portion of said side edge portions, and further comprising positioning said applicator means on one of said front surface of said back sheet and said back surface of said front sheet, and folding the other of said back sheet and said front sheet over said applicator.

7. A method according to claim 1, further comprising providing at least one of said front sheet and said back sheet as a continuous strip of material so as to provide a continuous strip of attachments.

8. A method according to claim 2, wherein said applicator means extends beyond said upper edge portion of said front sheet so as to define an exposed portion of said applicator means, whereby removal of said applicator means from said attachment is facilitated.

9. A method according to claim 8, further comprising the step of positioning a removable securing means over said exposed portion so as to secure said applicator means in said attachment until use.

10. A method according to claim 1, further comprising the step of providing indicia on at least one of said front sheet and said back sheet and visible at said front surface of said front sheet.

11. An attachment for a product in a container, comprising:

applicator means for application of said product;

a back sheet having a front surface and a back surface, and means for securing to said container positioned on said back surface; and a front sheet having a front surface and a back surface, said front sheet being secured to said back sheet with said applicator means releasably enclosed therebetween.

12. An attachment according to claim 11, wherein said means for securing comprises adhesive means positioned on said back surface of said back sheet, and peelable backing means for covering said adhesive means whereby peeling said peelable backing means exposes said adhesive means for attaching to said container.

13. An attachment according to claim 11, wherein said front sheet and said back sheet each have a top edge portion, side edge portions and a bottom edge portion, and wherein said front sheet is secured to said back sheet at least at said side edge portions so as to define a pouch which is substantially unsecured at said top edge portion, whereby said applicator means is readily removed from and returned to said pouch.

14. An attachment according to claim 13, wherein said front sheet and said back sheet are secured at said bottom edge portion.

15. An attachment according to claim 13, wherein said applicator means extends beyond said upper edge portion of said front sheet so as to define an exposed portion of said applicator means, whereby removal of said applicator means from said attachment is facilitated.

16. An attachment according to claim 15, further comprising a removable securing means positioned over said exposed portion so as to secure said applicator means in said attachment until use.

17. An attachment according to claim 11, further comprising indicia on at least one of said front sheet and said back sheet and visible at said front surface of said front sheet.

18. An attachment for holding an applicator to a container containing a product, comprising:

a sheet member having a front surface and a back surface, a top edge portion, side edge portions and a bottom edge portion; and adhesive means positioned at least at said side edge portions for securing said sheet to said container so as to define a pouch for holding said applicator, whereby said applicator can be readily removed from and returned to said pouch.

19. An attachment according to claim 18, further comprising peelable backing means covering said adhesive means, whereby peeling of said peelable backing means exposed said adhesive means for securing to said container.

20. A package, comprising:

a container containing a product;

applicator means for applying said product;

a sheet member having a front surface and a back surface, a top edge portion, side edge portions and a bottom edge portion; said sheet member being secured to said container at least at said side edge portions so as to define a pouch therebetween having a substantially open top edge portion, said applicator means being positioned within said pouch whereby said applicator means is readily removed from and returned to said pouch.

21. A package according to claim 20, wherein said container has a seam arranged substantially longitudinally thereon, and wherein said sheet member is positioned so as to define said pouch over said seam whereby said applicator means in said pouch rests in said seam.

* * * * *